US006863559B2

(12) United States Patent
Yu

(10) Patent No.: US 6,863,559 B2
(45) Date of Patent: Mar. 8, 2005

(54) ELECTRICAL CONNECTOR FOR FLEXIBLE PRINTED CIRCUIT

(75) Inventor: Wei Yu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/461,589

(22) Filed: Jun. 13, 2003

(65) Prior Publication Data

US 2004/0115987 A1 Jun. 17, 2004

(30) Foreign Application Priority Data

Dec. 13, 2002 (TW) ..... 91220211 U

(51) Int. Cl.[7] ..... H01R 12/12
(52) U.S. Cl. ..... 439/497; 439/579
(58) Field of Search ..... 439/492, 497, 439/579

(56) References Cited

U.S. PATENT DOCUMENTS 6,273,753 B1 * 8/2001 Ko ..... 439/579
6,315,616 B1 11/2001 Hayashi

* cited by examiner

*Primary Examiner*—Renee Luebke
(74) *Attorney, Agent, or Firm*—Wei Te Chung

(57) ABSTRACT

An electrical connector (1) for electrically connecting a flexible printed circuit (FPC) with a printed circuit board (PCB) includes an insulative housing (2), a shielding (3) mounted on the housing, and a plurality of conductive terminals (4) received in the housing. The shielding includes a first wall (31) and a second wall (32) parallel to the first wall. The second wall includes a plurality of grounding tabs (325) extending therefrom. This ensures that the housing receives the terminals stably, and this reduces manufacturing costs of the connector. Furthermore, a mating end (329) of the second wall has a double-layered configuration. This ensures that the shielding has good retention.

2 Claims, 3 Drawing Sheets

ELECTRICAL CONNECTOR FOR FLEXIBLE PRINTED CIRCUIT

BACKGROUND OF THE INVENTION

1. Field of the Invention

The present invention relates to an electrical connector, and particularly to an electrical connector for electrically connecting a flexible printed circuit (FPC) with a printed circuit board (PCB).

2. Description of Related Art

An electrical connector assembly for electrically connecting a flexible printed circuit (FPC) with a printed circuit board (PCB) comprises a plug connector mounted on a flexible printed circuit (FPC) and a mating socket connector mounted on a printed circuit board (PCB). The plug connector is mated with the socket connector to establish the electrical connection between the FPC and the PCB.

A conventional socket connector comprises an insulative housing, a shielding mounted on the housing, a plurality of conductive terminals received in the housing, and a plurality of grounding tabs assembled with the housing. The grounding tabs are electrically connected with the shielding. In addition, the grounding tabs are respectively electrically connected with corresponding grounding tabs of the plug connector.

A typical electrical connector assembly is disclosed in U.S. Pat. No. 6,315,616. A socket connector of the electrical connector assembly comprises an insulative housing, a shielding, a plurality of conductive terminals, and a plurality of grounding tabs. The housing has a plurality of passageways defined therein. The conductive terminals and the grounding tabs are respectively received in the corresponding passageways. Furthermore, each of the conductive terminals and the grounding tabs has barbs defined on sides thereof. The barbs interferentially mate with insulative walls that separate every two adjacent passageways, thereby retaining the conductive terminals and the grounding tabs in the passageways. Because a large number of passageways are defined on the housing, a distance between every two adjacent passageways is relatively small. Each insulative wall is relatively thin and weak. Therefore, the barbs are not always interferentially mated with the insulative walls securely, and the conductive terminals and the grounding tabs may not be securely retained in the passageways. When this happens, electrical connection between the conductive terminals and the grounding tabs of the socket connector and conductive terminals and grounding tabs of a mating plug connector may be unstable or even lost.

Because the grounding tabs and the shielding of the socket connector are two separate parts, during manufacturing the socket connector, two separate molds respectively corresponding to the grounding tabs and the shielding need to be adopted. This increases manufacturing costs of the connector. In addition, electrical connection between the grounding tabs and the shielding is necessarily impeded to some degree.

When the socket connector is mated with the plug connector, the grounding tabs of the socket connector press the corresponding grounding tabs of the plug connector, thereby establishing the electrical connection therebetween. The grounding tabs of the socket connector are also pressed by the grounding tabs of the plug connector, thereby pressing a mating end of the shielding of the socket connector. The mating end of the shielding has a single layered configuration, and is relatively weak. After repeated mating and unmating of an FPC with the connector, the mating end tends to become distorted. This can disrupt the electrical connection between the socket and plug connectors.

In view of the above, a new electrical connector that overcomes the above-mentioned disadvantages is desired.

SUMMARY OF THE INVENTION

Accordingly, an object of the present invention is to provide an electrical connector for electrically connecting a flexible printed circuit (FPC) with a printed circuit board (PCB), whereby the connector has a housing securely receiving a plurality of terminals therein.

Another object of the present invention is to provide an electrical connector for electrically connecting a flexible printed circuit (FPC) with a printed circuit board (PCB), whereby the connector has a relatively strong shielding.

A further object of the present invention is to provide an electrical connector for electrically connecting a flexible printed circuit (FPC) with a printed circuit board (PCB), whereby the connector has reduced manufacturing costs.

To achieve the above-mentioned objects, an electrical connector in accordance with a preferred embodiment of the present invention is for electrically connecting a flexible printed circuit (FPC) with a printed circuit board (PCB). The connector comprises an elongated insulative housing, a shielding mounted on the housing, and a plurality of conductive terminals received in the housing. The shielding comprises a first wall and a second wall parallel to the first wall. The second wall comprises a plurality of grounding tabs extending therefrom. This ensures that the housing receives the terminals stably, and this reduces manufacturing costs of the connector. Furthermore, a mating end of the second wall has a double-layered configuration. This ensures that the shielding has good retention.

Other objects, advantages and novel features of the invention will become more apparent from the following detailed description when taken in conjunction with the accompanying drawings, in which:

DETAILED DESCRIPTION OF PREFERRED EMBODIMENT OF THE INVENTION

Reference will now be made to the drawings to describe the present invention in detail.

Figure 1:
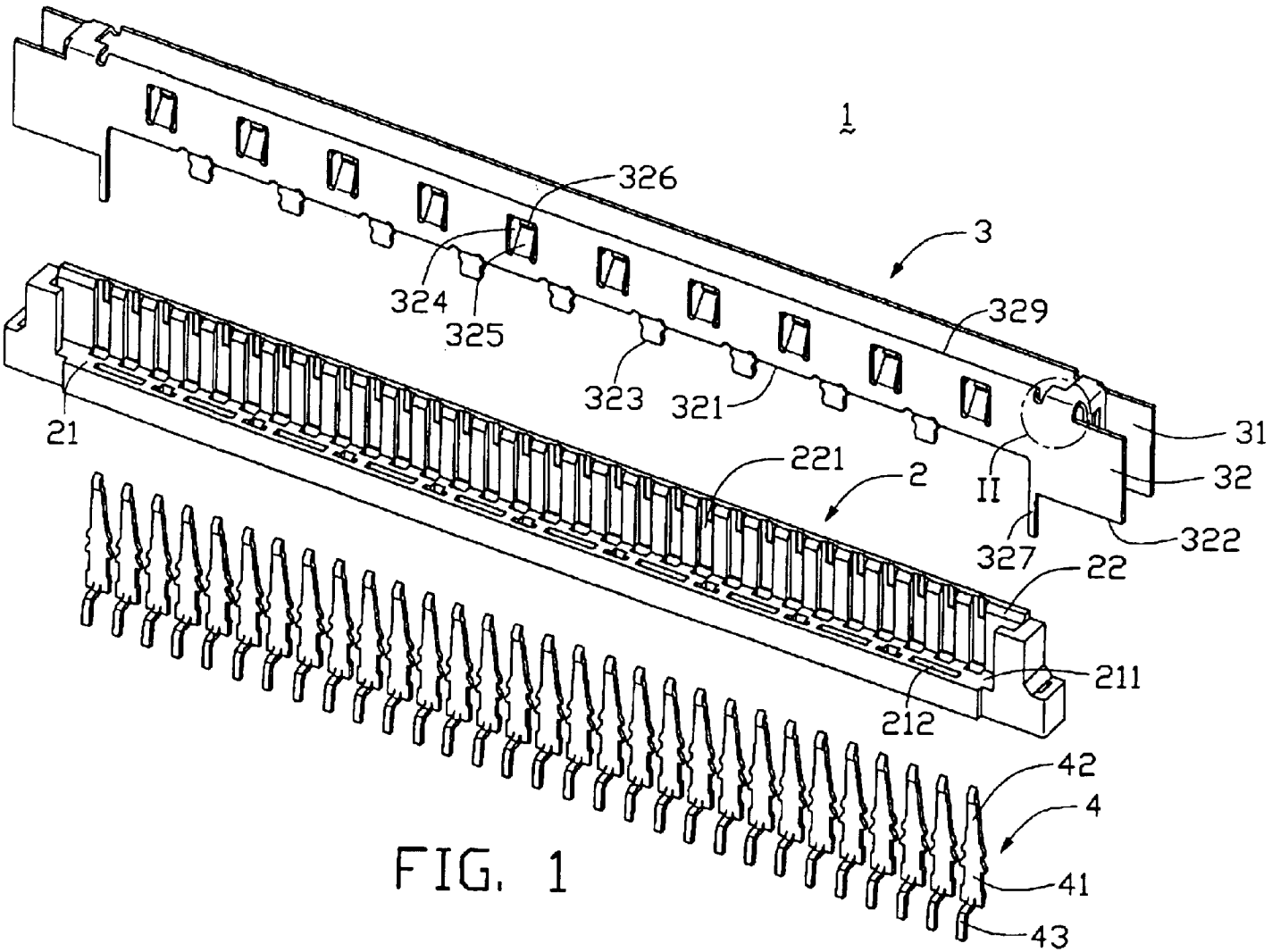
FIG. 1 is an exploded, isometric view of an electrical connector in accordance with the preferred embodiment of the present invention.
Figure 3:
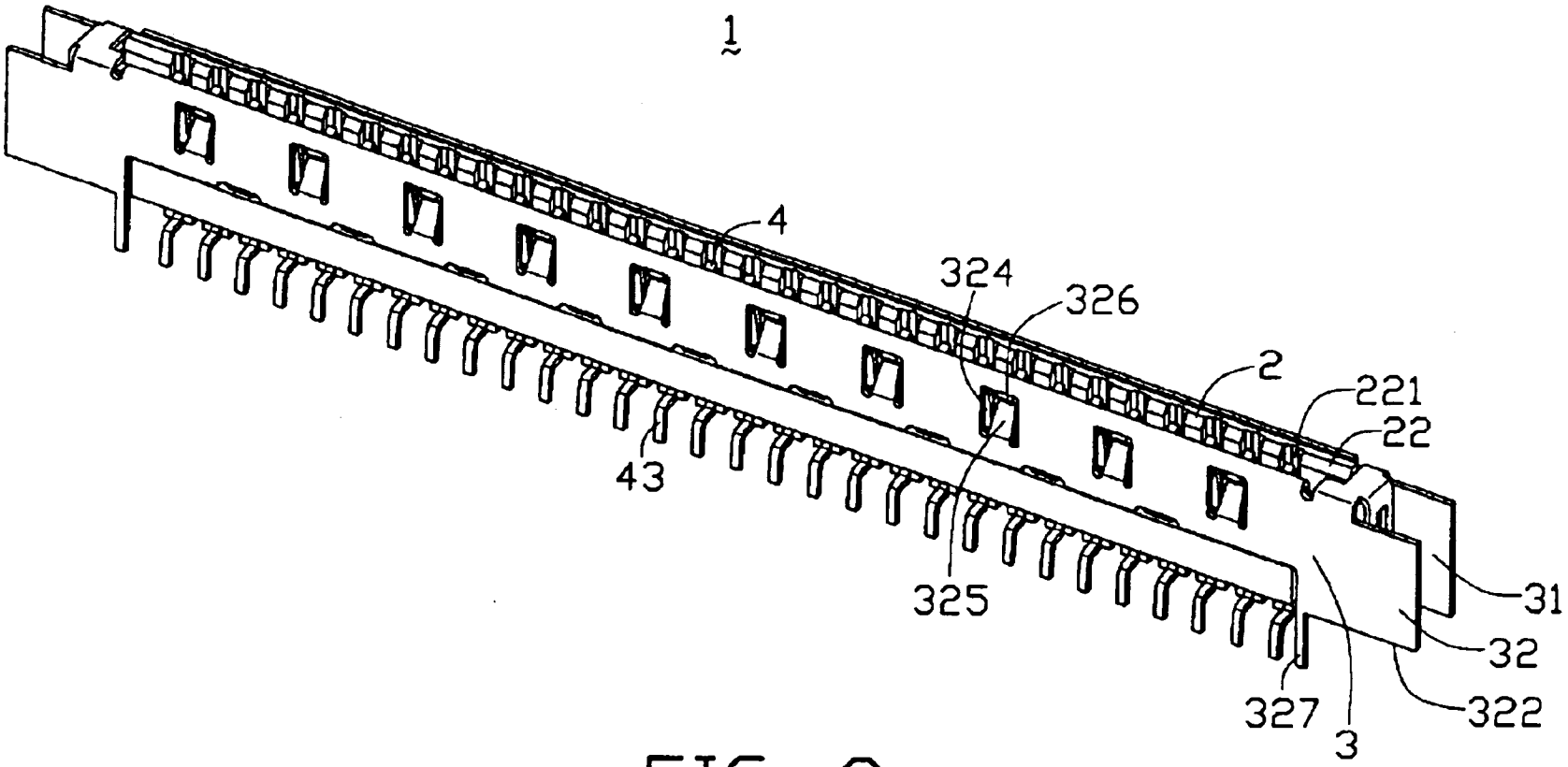
FIG. 3 is an assembled view of FIG. 1.

Referring to FIGS. 1 and 3, an electrical connector 1 in accordance with the preferred embodiment of the present invention is for electrically connecting a flexible printed circuit (FPC) (not shown) with a printed circuit board (PCB) (not shown). The connector 1 is mounted on the PCB, and comprises an insulative housing 2, a shielding 3 mounted on the housing 2, and a plurality of conductive terminals 4 received in the housing 2.

The housing 2 comprise a base portion 21, and a mating portion 22 extending perpendicularly upwardly from the base portion 21. The base portion 21 defines a mating surface 211 thereon, which is adjacent the mating portion 22.

A plurality of aligned, evenly spaced receiving slots 212 is defined in the mating surface 211 of the base portion 21. A plurality of parallel, evenly spaced passageways 221 is defined in the mating portion 22, generally facing the base portion 21. Each passageway 221 is perpendicular to and runs through the base portion 21.

The terminals 4 are respectively received in the corresponding passageways 221 of the housing 2. Each terminal 4 comprises a contact portion 42, a tail 43, and a retaining portion 41 interconnecting the contact portion 42 and the tail 43. The retaining portion 41 is interferentially mated with inner walls (not labeled) of the housing 2 in the corresponding passageway 221, thereby retaining the terminal 4 in the passageway 221. The tail 43 is mechanically and electrically connected with the PCB. The contact portion 42 is electrically connected with a corresponding conductive terminal (not shown) of the FPC.

The shielding 3 surrounds the housing 2, and comprises a first wall 31 and a second wall 32 parallel to the first wall 31. The second wall 32 comprises a narrow, lower contacting surface 321, and a pair of bottom surfaces 322 defined at opposite ends of the contacting surface 321 respectively. A plurality of evenly spaced protrusions 323 extends from the contacting surface 321, corresponding to the receiving slots 212 of the housing 2. The second wall 32 is mounted on the base portion 21 of the housing 2, with the contacting surface 321 mating with the mating surface 211 of the base portion 21, and the protrusions 323 being respectively received in the corresponding receiving slots 212. Each bottom surface 322 has a conductive leg 327 depending therefrom adjacent the contacting surface 321. The bottom surfaces 322 are mounted on the PCB, and the conductive legs 327 are mechanically and electrically connected with the PCB.

Figure 2:
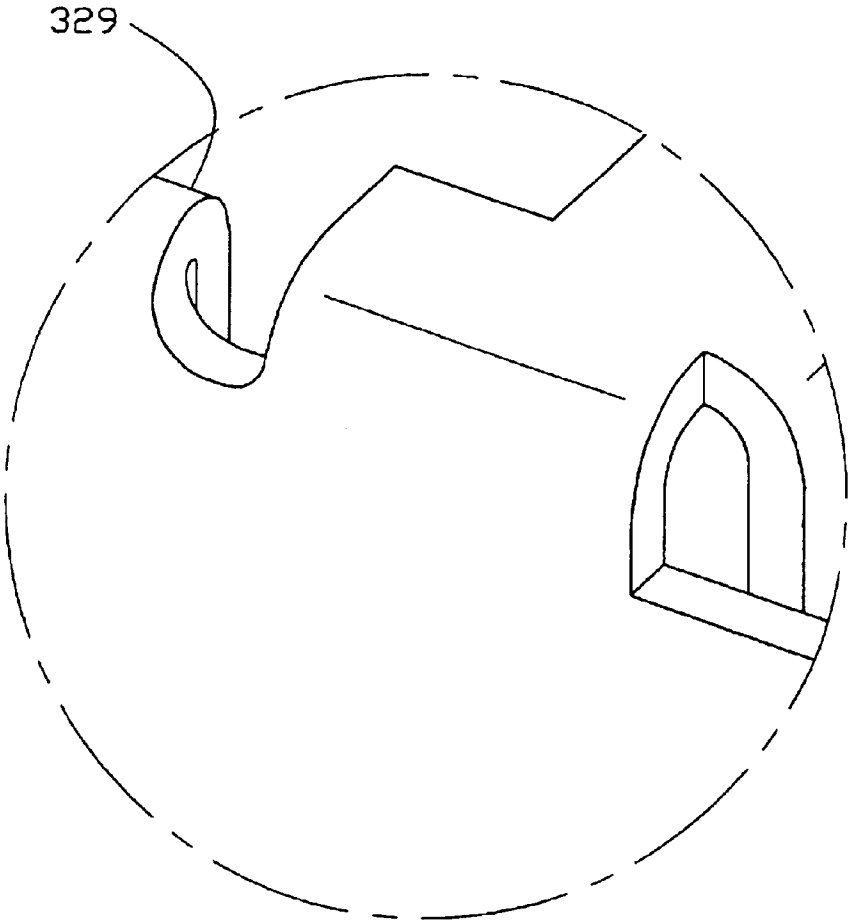
FIG. 2 is an enlarged view of a circled portion II of FIG. 1.

The second wall 32 further comprises a mating end 329 opposite to the contacting surface 321. Referring also to FIG. 2, the mating end 329 extends upwardly from a main portion of the second wall 32, and then bends back downwardly to double over itself. Thus, the mating end 329 has a generally double-layered configuration.

The second wall 32 of the shielding 3 defines a plurality of evenly spaced rectangular windows 324 therein. A number of the windows 324 is one more than a number of the protrusions 323, with the protrusions 323 being evenly arranged along a length of the second wall 32 generally interspersed between the windows 324. A grounding tab 325 extends slantwisedly upwardly from the second wall 32 at a bottom of each window 324 near the contacting surface 321, the grounding tab 325 also extending slightly toward the first wall 31. The grounding tab 325 has a cantilevered configuration, and forms a mating portion 326 at a free end thereof. The mating portion 326 is for mating with a corresponding grounding tab of the FPC.

In the connector 1 of the present invention, the grounding tabs 325 extend from the shielding 3, and the housing 2 does not need additional passageways defined therein to receiving the grounding tabs 325. The passageways 221 of the housing 2 only receive the terminals 4 therein. This ensures that a distance between every two adjacent passageways 221 can be relatively large. Insulative walls (not labeled) of the housing 2 between every two adjacent passageways 221 can thereby ensure stable retention of the terminals 4 in the passageways 221.

Because the grounding tabs 325 are integrally formed on the shielding 3, electrical connection between the grounding tabs 325 and the shielding 3 is unimpeded. In addition, only a single mold (not shown) needs to be used to manufacture the shielding 3. This reduces manufacturing costs of the connector 1.

The mating end 329 of the second wall 32 of the shielding 3 has a double layered configuration, thereby reinforcing the shielding 3. Thus the mating end 329 resists distortion, even after repeated mating and unmating of the FPC with the connector 1. This ensures that connection between the FPC and the connector 1 is reliable.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector comprising:

an insulative housing defining a plurality of passageways therein;

a plurality of terminals disposed in corresponding passageways, respectively, and commonly facing in a lateral direction; and a one-piece metallic shielding defining elongated parallel spaced first and second walls linked to each other via top portions thereof, the first wall abutting against the housing laterally while the second wall spaced from both the housing and said terminals in said lateral direction; wherein a plurality of grounding tabs are directly stamped out of the second wall toward the terminals in a direction opposite to said lateral direction.

2. The connector as claimed in claim 1, wherein said second wall further includes a plurality of protrusions downwardly extending from a lower edge thereof and respectively received in corresponding receiving slots in the housing.

* * * * *